United States Patent [19]

Kawai et al.

[11] Patent Number: 4,938,714

[45] Date of Patent: Jul. 3, 1990

[54] ELECTRICAL CONNECTOR

[75] Inventors: Mitsuru Kawai; Masaru Yoshida; Yoshihiro Sasaki, all of Tokyo, Japan

[73] Assignee: Hirose Electric Co., Ltd., Tokyo, Japan

[21] Appl. No.: 404,629

[22] Filed: Sep. 8, 1989

[30] Foreign Application Priority Data

Oct. 4, 1988 [JP] Japan ..... 63-249148

[51] Int. Cl.[5] ..... H01R 13/648

[52] U.S. Cl. ..... 439/607; 439/95; 439/135; 439/609

[58] Field of Search ..... 439/607-610, 439/92, 95, 108, 135, 668, 148

[56] References Cited

U.S. PATENT DOCUMENTS 4,406,506 9/1983 Baldwin ..... 439/607 X
4,568,133 2/1986 Amano et al. ..... 439/607 X
4,637,669 1/1987 Tajima ..... 439/609 X
4,842,554 6/1989 Cosmos et al. ..... 439/609
4,842,555 6/1989 Cosmos et al. ..... 439/609

FOREIGN PATENT DOCUMENTS 59-143287 8/1984 Japan .
61-184285 11/1986 Japan .

*Primary Examiner*—Steven C. Bishop
*Attorney, Agent, or Firm*—Kanesaka & Takeuchi

[57] ABSTRACT

An electrical connector has an insulating housing having an annular recess for receiving the shell member of a mating connector; a cylindrical shield member fitted in the annular recess, which includes shield contacts extending in radial directions from a front edge of the shield member; a detachable end face protection member attached to the front end of the insulating housing for protection thereof, which includes an latch member for latching the detachable end face protection member to the front end, whereby the shield contact comes into contact a backside of the end face protection member.

6 Claims, 4 Drawing Sheets

ELECTRICAL CONNECTOR

BACKGROUND OF THE INVENTION

The present invention relates generally to shielded electrical connectors and, more particularly, to an electrical connector having the improved shielding and anti-static effects.

Japanese U.M. Patent Application Kokai No. 61-184285 (the '285 patent) discloses an electrical connector which includes an insulating housing with an annular recess for receiving the shell member or outer contact of a mating connector. A cylindrical shield member fitted in the annular recess has cantilever contact members with a spring free end for contact with a metallic shield of the mating connector. It also has legs projecting from the rear slit to be mounted on a printed circuit board.

Japanese Patent Application Kokai No. 59-143287 (the '287 patent) discloses an electrical connector receptacle which includes a shield member fitted in an annular channel and a flat metal grounding terminal for covering the front end of the receptacle. This electrical connector has EMI and anti-static protection to a certain extent.

However, the front end of the electrical connector of the '285 patent is not covered by the shield member so that interference electromagnetic waves can enter through the front end, causing electromagnetic interference. In addition, if the charged finger contacts the front end, static electricity flows through the contact, causing malfunction in the electrical circuit. Moreover, the mechanical strength of a dielectric material for the front end is lower than that of metals so that the front end is liable to scratch or breakage upon plugging in or out, or by an external force.

The ground terminal of the electrical connector according to the '287 patent consisting of a flat metal sheet and a series of contacts aligned in a cylindrical form has the following disadvantages.

(1) The outer diameter of an annular recess in the insulating housing must be much larger than that of the shell member of a mating connector for receiving the contacts aligned in a cylindrical form. Consequently, when the shell member of the mating connector is plugged in the annular recess, there is a large gap between them. As a result, the contact pin or member can be deformed or bent by an unexpected force applied upon plugging in or out.

(2) The flat metal sheet must be thick for providing mechanical strength while it must be thin for accommodating elastic deformation of the contacts upon plugging in or out. In other words, too thick metal sheets produce poor contacts while too thin metal sheets fail to provide a rigid flat terminal.

(3) Although the flat section does not require any spring property, the contacts must be made from a spring metal so that a spring metal is used to make the entire ground terminal. However, the hardness of such metal is so high that it is very difficult to machine because of spring back, etc. In addition, spring metal is expensive, pushing up the unit manufacturing cost.

(4) Once the ground terminal is attached to the connector and mounted on a printed circuit board, it is so difficult to remove it from the insulating housing that it is almost impossible to replace it with another flat terminal for providing another function such as a different shielding effect, prevention of a wrong connection or adherence of dust and dirt.

SUMMARY OF THE INVENTION

Accordingly, it is an object of the present invention to provide an electrical connector with the improved shielding effect.

It is another object of the invention to provide an electrical connector which is easy to be assembled and dissembled.

It is still another object of the invention to provide an electrical connector with a strong shielding member.

According to the invention there is provided an electrical connector which includes an insulating housing having an annular recess extending rearward from a front end thereof for receiving a portion of a mating connector; a cylindrical shield member fitted in the annular recess, the shield member including a first shield contact for contact with a conductive shield of the mating connector; a second shield contact for contact with an electrical circuit; and a third shield contact extending in radial directions from a front edge of the shield member; a detachable end face protective member attached to the front end of the insulating housing for protection thereof, the detachable end face protective member including: a circular central opening for receiving the mating connector portion; a engaging member for latching the detachable end face protective member to the front end; and a contact member for contact with the third shield contact member.

With the end face protection member according to the invention, it is possible not only to provide the improved shielding effect but also to prevent malfuction of the electrical circuit by touching the front end of the electrical connector with the finger to discharge the static electricity. The end face protection member separated from the shield member is sufficiently thick to provide satisfactory strength. The detachable end face protective member is so easy to remove from the insulating housing that a variety of end face protection members are used according to applications.

Other objects, features, and advantages of the invention will be apparent from the following description when taken in conjuction with the accompanying drawings.

DESCRIPTION OF THE PREFERRED EMBODIMENT

Figure 1:
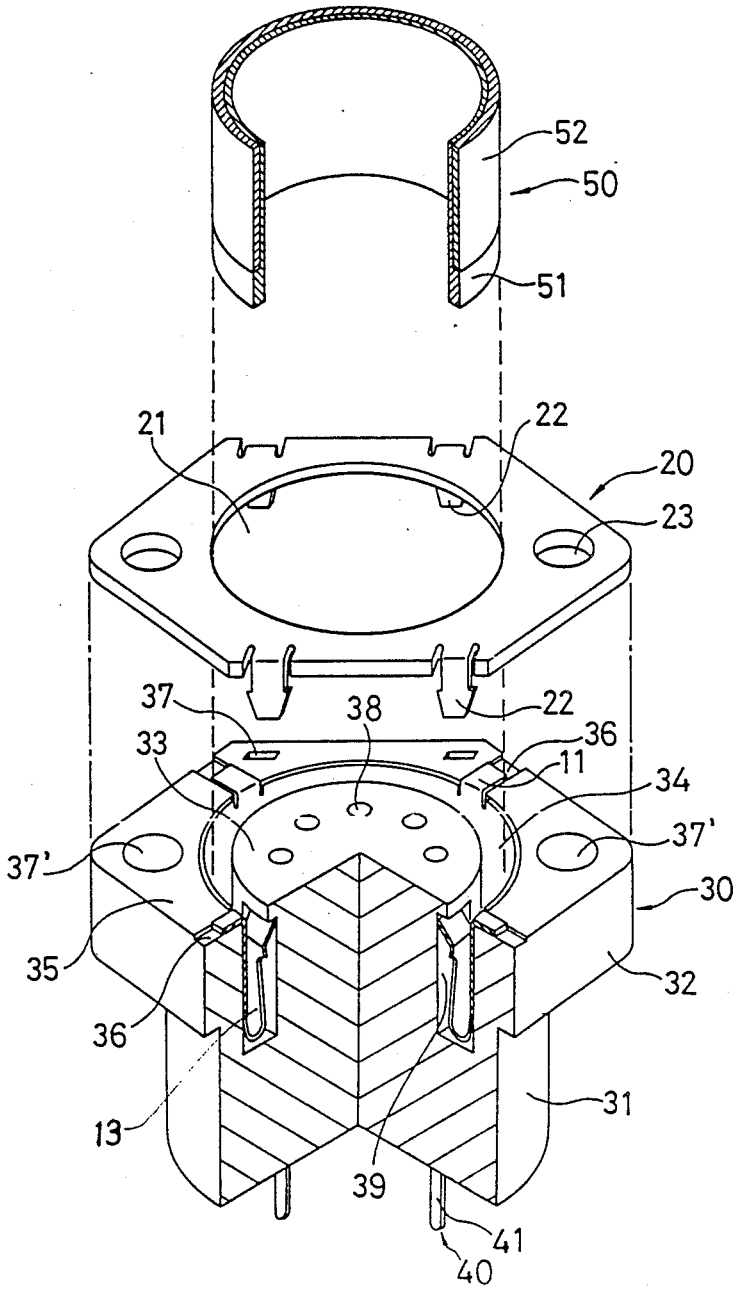
FIG. 1 is a partially cutaway exploded perspective view of an electrical connector according to an embodiment of the invention.

FIG. 1 shows an electrical connector according to an embodiment of the invention. This electrical connector includes a shield member 10, an end face protection member 20, an insulating housing 30, and contacts 40.

Figure 2:
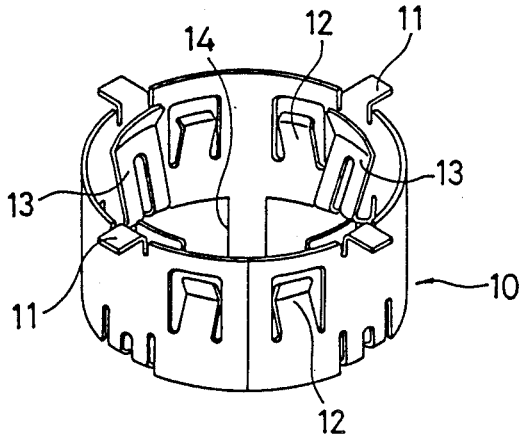
FIG. 2 is a perspective view of a shield member useful for the electrical connector of FIG. 1.

As best shown in FIG. 2, the shield member 10 is made by stamping and forming a spring metal thin sheet into a cylindrical shape. It has a plurality of contact tabs 11 which extend from the front edge in radial directions and, when it is put in the insulating housing 30, fit in contact grooves 36 provided on an enlarged front section 32 of the insulating housing 30 which is detailed hereinafter. Also, it has a plurality of cantilever contacts 12 made by stamping out C-shaped pieces and bending inwardly and then outwardly in a substantially L-shaped longitudinal section. Further, it has a plurality of latch members 13 extending upward from the rear edge, which is made by bending by 180 degrees upward and then inward in a substantially L-shaped longitudinal section. A leg member 14 extends downward from the rear edge for contact with a grounding circuit (not shown).

As best shown in FIG. 1, the end face protection member 20 is made by stamping and forming a relatively thick metal sheet. It has a hexagonal shape substantially identical with the front end of the insulating housing 30 and a circular central opening 21 for receiving the shell member 50 of a mating connector. Two pairs of arrowhead shaped engaging members 22 extend downwardly from opposing two sides of the protection member 20 for insertion into engaging slots 37 of the insulating housing 30. These engaging members 22 are detachable from the engaging slots 37 by means of a simple removing tool. A pair of through holes 23 are provided for receiving attaching bolts (not shown).

The insulating housing 30 is molded from an insulating material, such as a plastic, to have a lower cylindrical body 31, a hexagonal enlarged front section 32, and a contact support 33 extending upward into the front section 32 from the cylindrical body 31 to define an annular recess 34 for receiving the shield member 10. As described above, the front section 32 has the contact grooves 36 on the front face 35 corresponding to the contact tabs 11 and the engaging slots 37 for engagement with the engaging member 22 of the protection member 20. A pair of through holes 37' are provided for receiving attaching bolts. The contact support 33 has a plurality of contact holes 38 for supporting contacts 40. A plurality of engaging recesses 39 are provided on the circumferential surface of the contact support 33 for engaging with the latch members 13 of the shield member 10.

The contact 40 has a contact section (not shown) for contact with the contact of a mating connector within the insulating housing and a connection section 41 extending downwardly from the insulating housing for connection with the electrical circuit of a printed circuit board (not shown).

The shield member 10 and the end face protection member 20 are assembled into the insulating housing 30 in the following manner.

(1) The shield member 10 as shown in FIG. 2 is inserted into the annular recess 34 of the insulating housing 30 so that the contact tabs 11 engage the contact grooves 36, with the result that the top surface of the contact tabs 11 slightly project beyond the surface 35 of the front section 32. Preferably, the contact tab 11 has a spring tip projecting beyond the front surface of the insulating housing.

(2) The end face protection member 20 is then mounted on the insulating housing 30 so that the engaging members 22 are inserted into the engaging slots 37 for latching. Consequently, the lower surface of the protection member 20 comes into electrical contact with the upper surface of each contact tab 11, providing shielding effects in the circumferential and front sections of the electrical connector. When the connector is plugged in, the protection member 20 comes into contact with operator's finger so that static electricity is discharged, thereby protecting the electrical circuit from malfunction.

(3) When the shell member 50 of a mating connector is plugged in the electrical connector, the shell member 50 is guided by the central opening 21 of the protection member 20 so that even if the mating connector is plugged in or out violently, no excessive forces are applied to the contact members 12 and the latch member 13 of the shield member, thus preventing damage to the electrical connector.

Figure 3:
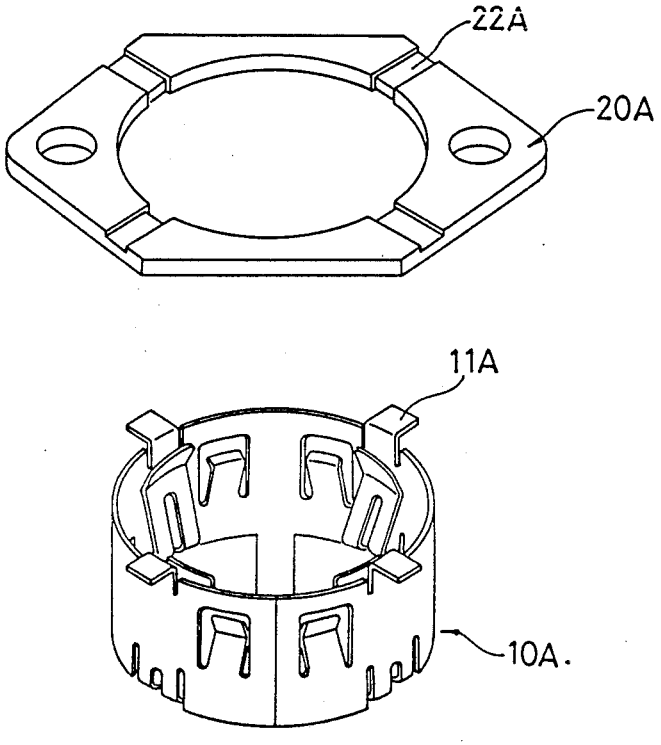
FIG. 3 is a perspective view of a shield member and an end face protection member according to another embodiment of the invention.

FIG. 3 shows a shield member 10A and an end face protection member 20A according to another embodiment of the invention. The shield member 10A is identical with the shield member 10 of FIG. 2 except that the contact tabs 11A project forward more than the contact tabs 11 of FIG. 2. The protection member 20A has contact grooves 22A in corresponding positions for receiving the contact tabs 11A.

With these shield and protection members 10A and 20A, not only it is possible to provide better electrical connection between them but also it is easier to attach or detach the protection member 20A from the shield member 10A.

Figure 4:
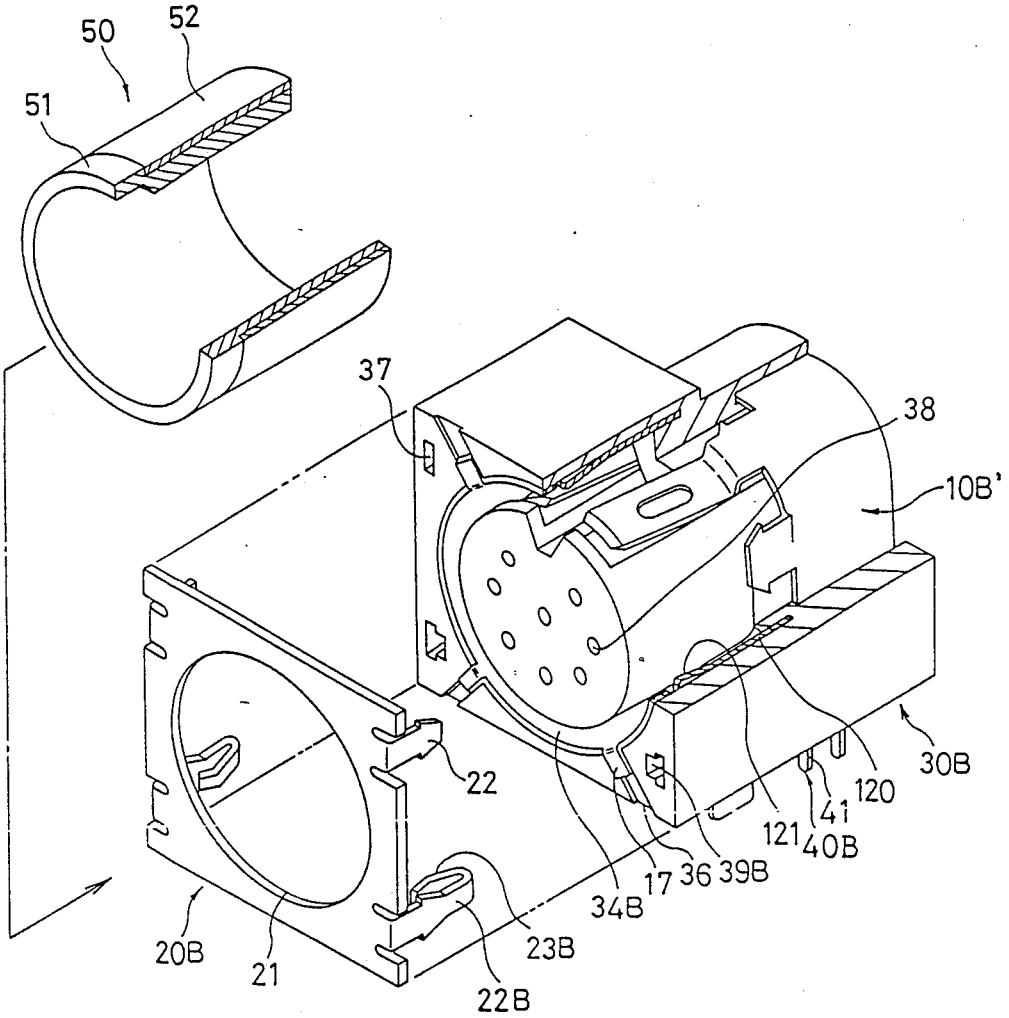
FIG. 4 is a partially cutaway, exploded perspective view of an electrical connector according to still another embodiment of the invention.
Figure 5:
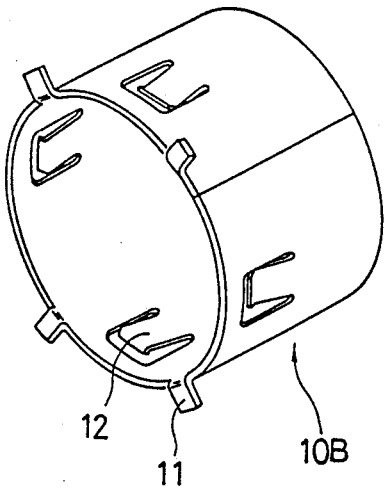
FIG. 5 is a perspective view of a shield member useful for the electrical connector of FIG. 4.

FIGS. 4 and 5 show an electrical connector according to still another embodiment of the invention, wherein a mating connector is plugged into the connector in the direction parallel to a printed circuit board. This electrical connector includes a pair of shield members 10B, 10B', an end face protection member 20B, an insulating housing 30B, and contacts 40B.

As best shown in FIG. 5, the front shield member 10B is identical with the shield member 10 of FIG. 2 except for the latch members 13 and the leg member 14. The rear shield member 10B' is substantially identical with that of the '285 patent. The end face protection member 20B has a square shape substantially identical with the front end of the insulating housing 30B. The engaging member 22B has a contact member 23B for contact with the free end 121 of a latch member 120 of the shield member 10B'. The other portions are identical with those of the end face protection member 20.

The insulating housing 30B has a cubic front portion with an annular recess 34B for receiving the shield member 10B and the shell member 50 of a mating connector. It also has a rear opening for receiving the rear shield member 10B'. Provided on the front surface of the insulating housing 30B are insertion slots 39B into which the engaging members 22B are inserted for contact with the free ends 121 of the latch members 120 and engaging slots 37 into which arrowhead shaped engaging members 22 are inserted for engagement. An end of each L-shaped contact 40B is inserted into a contact hole 38 of the insulating housing while the other end projects from the bottom of the insulating housing.

Figure 6:
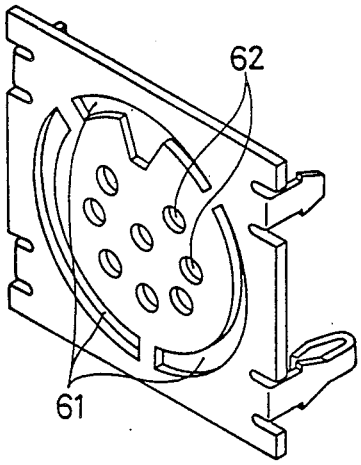
FIG. 6 is a perspective view of an end face protection member according to yet another embodiment of the invention.

FIG. 6 shows an end face protection member having enhanced shielding and anti-static effects according to yet another embodiment of the invention. In contrast to the above three embodiments wherein the end face protection member has a completely circular central opening for receiving the shell member of a mating connector, this end face protection member has arcuate slots 61 through which divided shell sections are inserted and contact holes 62 through which contacts are inserted so that it covers almost all the front surface. Thus, it provides good shielding and anti-static effects because of easy touching by the finger.

Figure 7:
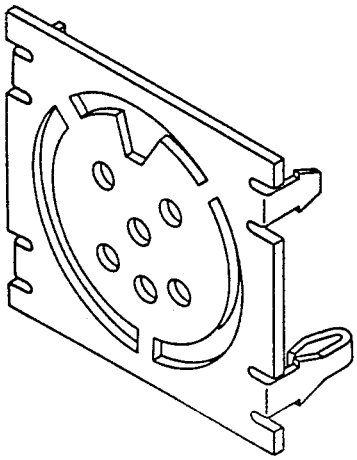
FIG. 7 is a perspective view of an end face protection member according to still another embodiment of the invention.

FIG. 7 shows an end face protection member according to still another embodiment of the invention, wherein the number of contact holes is made equal to the number of contacts of a mating connector. This end face protection member has more enhanced shielding effects than any of the above protection members. Also, it is effective to prevent wrong connection when a number of similar connectors are mounted side by side.

Figure 8:
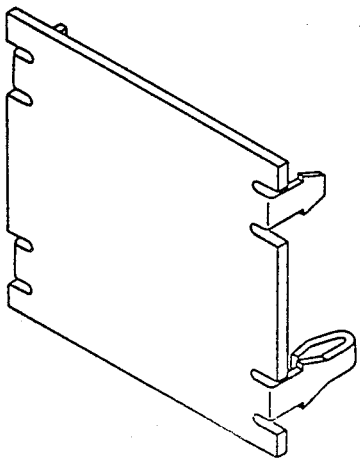
FIG. 8 is a perspective view of an end face protection member according to yet another embodiment of the invention.

FIG. 8 shows an end face protection member according to yet another embodiment of the invention. This protection member is used to cover the entire front end of a connector when it is not used for a long time to prevent dust and dirt from adhering to the contact portions of contacts.

(1) The end face protection member is electrically connected to the shield member so that nearly perfect EMI and anti-static protection is provided.

(2) The central opening of the end face protection member guides insertion of the shell member of a mating connector so that when the mating connector is plugged in or out, no or little damage is made to the spring contacts and/or latch members of the shield member and no excessive load is applied to the contact pins of the mating connector.

(3) Since the shield member and the end face protection member are separated, the shield member is made from a spring thin metal sheet so that the mating connector is plugged in or out with small forces. Since the end face protection member is made from a relatively soft, thick metal sheet, not only it is easy to machine but also the material is inexpensive. In addition, the thick sheet covers the front end of an insulating housing so that when the mating connector is plugged in or out or an external force is applied, no or little damage is made to the front end of the insulating housing.

(4) Since it is easy to attach or detach the end face protection member from the front end of an insulating housing, a variety of end face protection members are used according to applications without any difficulty.

What is claimed is:

1. An electrical connector comprising:

an insulating housing having an annular recess extending rearward from a front end thereof for receiving a portion of a mating connector;

a cylindrical shield member fitted in said annular recess, said shield member including:

first shield contact means for contact with a conductive shield of said mating connector;

second shield contact means for contact with an electrical circuit; and third shield contact means extending in radial directions from a front edge of said shield member;

a detachable end face protection member attached to said front end of said insulating housing for protection thereof, said detachable end face protection member including:

engaging means for latching said detachable end face protection member to said front end, whereby said third shield contact means comes into contact with a backside of said end face protection member.

2. The electrical connector of claim 1, wherein said detachable end face protection member has opening means for receiving said mating connector portion.

3. The electrical connector of claim 2, wherein said opening means is composed of a plurality of arcuate slots.

4. The electrical connector of claim 2, wherein said end face protection member has a plurality of holes through which contact pins of said mating connector are inserted.

5. An electrical connector comprising:

an insulating housing having an annular recess extending rearward from a front end thereof for receiving a portion of a mating connector;

a cylindrical shield member fitted in said annular recess, said shield member including:

first shield contact means for contact with a conductive shield of said mating connector;

second shield contact means for contact with an electrical circuit; and third shield contact means extending in radial directions from a front edge of said shield member;

a detachable end face protection member attached to said front end of said insulating housing for protection thereof, said detachable end face protection member including:

engaging means for latching said detachable end face protection member to said shield member, whereby said third shield contact means comes into contact said end face protection member.

6. The electrical connector of claim 5, wherein said engaging means is grooves provided on a front surface of said end face protection member.

* * * * *